US010352220B2

(12) United States Patent
Nagata

(10) Patent No.: US 10,352,220 B2
(45) Date of Patent: Jul. 16, 2019

(54) EXHAUST GAS STIRRING DEVICE

(71) Applicant: FUTABA INDUSTRIAL CO., LTD., Okazaki-shi, Aichi (JP)

(72) Inventor: Yoshinobu Nagata, Okazaki (JP)

(73) Assignee: FUTABA INDUSTRIAL CO., LTD., Okazaki-Shi, Aichi (JP)

( * ) Notice: Subject to any disclaimer, the term of this patent is extended or adjusted under 35 U.S.C. 154(b) by 260 days.

(21) Appl. No.: 15/315,100

(22) PCT Filed: May 28, 2015

(86) PCT No.: PCT/JP2015/065422

§ 371 (c)(1),
(2) Date: Nov. 30, 2016

(87) PCT Pub. No.: WO2015/182709

PCT Pub. Date: Dec. 3, 2015

(65) Prior Publication Data

US 2017/0191398 A1 Jul. 6, 2017

(30) Foreign Application Priority Data

May 30, 2014 (JP) ..... 2014-113113

(51) Int. Cl.
*B01F 5/04* (2006.01)
*F01N 3/24* (2006.01)
(Continued)

(52) U.S. Cl.
CPC ..... *F01N 3/24* (2013.01); *B01F 3/04049* (2013.01); *B01F 5/0473* (2013.01);
(Continued)

(58) Field of Classification Search
CPC ..... F01N 3/24; F01N 3/2892; B01F 3/04049; B01F 5/0473; B01F 5/06; B01F 5/0616; B01F 2005/0639
(Continued)

(56) References Cited

U.S. PATENT DOCUMENTS

2008/0267780 A1 10/2008 Wirth
2010/0101219 A1* 4/2010 Noller ..... B01F 3/04049 60/297
2013/0188444 A1* 7/2013 Palmer ..... B01F 5/0473 366/337

FOREIGN PATENT DOCUMENTS

JP 2008-274941 A 11/2008

* cited by examiner

*Primary Examiner* — Marc C Howell
(74) *Attorney, Agent, or Firm* — Withrow & Terranova, P.L.L.C.; Vincent K. Gustafson

(57) ABSTRACT

The exhaust gas stirring device comprises a cylindrical frame on an inner surface of a flow path member forming an exhaust flow path; supporting parts arranged to radially reach across the frame; a shielding part shielding a central axis of the frame and its circumference in the axis direction of the frame. One of the supporting parts comprises a pair of first skeletons extending radially outwardly from the central axis of the frame. The frame and the supporting parts are configured by assembling assembling members. One of the assembling members comprises the pair of first skeletons, and second skeletons respectively extending in an arc shape from one end of each of the first skeletons and constituting a part of the frame. Each of the first skeletons and the second skeletons in the assembling members comprises a vane part formed to protrude respectively from each of the first and second skeletons.

7 Claims, 8 Drawing Sheets

(51) Int. Cl.

| | |
|---|---|
| ***B01F 5/06*** | (2006.01) |
| ***B01F 3/04*** | (2006.01) |
| ***F01N 3/08*** | (2006.01) |
| ***F01N 3/20*** | (2006.01) |
| ***F01N 3/28*** | (2006.01) |

(52) U.S. Cl.
CPC ..... *B01F 5/0486* (2013.01); *B01F 5/06* (2013.01); *B01F 5/0616* (2013.01); *F01N 3/08* (2013.01); *F01N 3/2066* (2013.01); *F01N 3/28* (2013.01); *F01N 3/2892* (2013.01); *B01F 2005/0435* (2013.01); *B01F 2005/0639* (2013.01)

(58) Field of Classification Search
USPC ..... 366/336, 337
See application file for complete search history.

EXHAUST GAS STIRRING DEVICE

CROSS-REFERENCE TO RELATED APPLICATIONS

This application is a 35 U.S.C. § 371 national phase filing of International Application No. PCT/JP2015/065422 filed on May 28, 2015, and claims the benefit of Japanese Patent Application No. 2014-113113 filed on May 30, 2014 with the Japan Patent Office. The entire disclosures of International Application No. PCT/JP2015/065422 and Japanese Patent Application No. 2014-113113 are hereby incorporated by reference herein in their respective entireties.

TECHNICAL FIELD

The present invention relates to an exhaust gas stirring device for stirring an exhaust gas in an exhaust flow path.

BACKGROUND ART

An exhaust gas discharged from an internal combustion engine such as a diesel engine contains nitrogen oxide (NOx), which is an air pollutant. One known exhaust gas purifying system for purifying such an exhaust gas is an exhaust gas purifying system configured to provide an SCR (Selective Catalytic Reduction) type catalyst in the exhaust flow path and to jet urea water, which is a reducing agent, in the exhaust gas upstream of the catalyst. Such urea water jetted into the exhaust gas is hydrolyzed by heat of the exhaust gas. And, ammonia (NH3) generated by the hydrolysis of the urea water is supplied to the catalyst together with the exhaust gas. Nitrogen oxide within the exhaust gas reacts with ammonia in the catalyst and is reduced and purified.

In such type of an exhaust gas purifying system, the exhaust gas stirring device for stirring the exhaust gas that flows through the exhaust flow path is disposed upstream of the catalyst, so that a bias does not occur easily in a distribution of the exhaust gas (including a reducing agent) that flows into the catalyst. The exhaust gas stirring device is formed of a single metal plate member into a shape having vanes that protrude from a cylindrical tubular body as disclosed in, for example, Patent Document 1. The metal plate member has a belt part formed in a straight line, and vane parts that protrude from one end-side of the belt part in width direction. The tubular body is formed by cylindrically rolling the belt part of the metal plate member. The vane parts are formed to protrude inwardly from the tubular body.

PRIOR ART DOCUMENT

Patent Document

Patent Document 1: Japanese Unexamined Patent Application Publication No. 2008-274941

SUMMARY OF THE INVENTION

Problems to be Solved by the Invention

However, in the exhaust gas stirring device disclosed in the aforementioned Patent Document 1, a part where no vanes exist (aperture) inside the tubular body is larger as viewed from a direction along a central axis of the tubular body. Thereby, the flow of the exhaust gas is tend to bias towards the aperture, diffusibility of the exhaust gas decreases, and moreover, the urea water, the reducing agent jetted into the exhaust gas passes through the aperture of the exhaust gas stirring device, letting the urea water to slip through. Meanwhile, pressure loss of the exhaust flow path would grow too large if the vanes are formed simply to occlude the aperture. On another end, a yield rate in manufacturing would turn out low if the vanes are formed to occlude the aperture by being creative with the shape of the metal plate member.

In one aspect of the present invention, it is desirable to provide an exhaust gas stirring device that is capable of improving the diffusibility of the exhaust gas in the exhaust flow path, has a high degree of freedom in shape, and provides a high yield rate in manufacturing.

Means for Solving the Problems

An exhaust gas stirring device according to one aspect of the present invention is an exhaust gas stirring device that stirs an exhaust gas flowing through an exhaust flow path. The exhaust gas stirring device comprises a frame in a cylindrical shape arranged on an inner surface of a flow path member that forms the exhaust flow path, a plurality of supporting parts arranged to reach across the frame in a radial direction, and a shielding part shielding a central axis of the frame and its circumference in an axis direction of the frame. A first one of the plurality of supporting parts comprises a pair of first skeletons that extends outwardly from the central axis of the frame in the radial direction. The frame and the plurality of supporting parts are configured by assembling at least a plurality of assembling members. A first one of the plurality of assembling members comprises the pair of first skeletons, and second skeletons that are respectively extended in an arc shape from one end of each one of the pair of first skeletons and constitute a part of the frame. Each one of the pair of first skeletons and the second skeletons in the plurality of assembling members comprises a vane part that is formed to protrude respectively from each one of the pair of first skeletons and the second skeletons.

In the exhaust gas stirring device, the frame and the plurality of supporting parts are configured by assembling at least the plurality of assembling members. The first one of the plurality of assembling members comprises the pair of first skeletons, and the second skeletons that are respectively extended in an arc shape from one end of each one of the pair of first skeletons; and each one of the pair of first skeletons and the second skeletons comprises the vane part. Thus, a large number of the vane parts can be arranged efficiently on the frame and on the plurality of supporting parts, and diffusibility of the exhaust gas can be improved. In an exhaust gas purifying system that is configured to provide an SCR type catalyst in an exhaust flow path and to jet a reducing agent (for example, urea water) in the exhaust gas upstream of the exhaust flow path, the diffusibility and exhaust gas purifying performance of the reducing agent jetted into the exhaust gas can be particularly improved.

The exhaust gas stirring device also comprises the shielding part that shields the central axis of the frame and its circumference in the axis direction of the frame. More specifically, the shielding part is disposed on an area inside the frame where an aperture, which has no vane parts when viewed from the direction along the central axis of the frame, may be easily formed. Thus, an occurrence of bias in the flow of the exhaust gas and weakening of diffusibility of the exhaust gas can be reduced. In the aforementioned exhaust gas purifying system, the shielding part can particularly reduce a slipping-through of the reducing agent jetted into the exhaust gas. The reducing agent jetted into the exhaust gas is diffused by hitting the shielding part and is further diffused at the vane part, thus providing additional effect of improving the diffusibility of the reducing agent.

As mentioned above, the frame and the plurality of supporting parts are configured by assembling at least the plurality of assembling members in the exhaust gas stirring device. Thereby, the whole shape of the frame and the plurality of supporting parts can be easily altered to meet a required performance or other requirements, and thus a degree of freedom in shape thereof can be improved. And, the yield rate in manufacturing can also be improved by shaping the parts that configure the assembling members (for example, the first skeletons, the second skeletons, and the vane parts) into an identical or similar shape.

As mentioned above, one aspect of the present invention can provide an exhaust gas stirring device that is capable of improving diffusibility of an exhaust gas in an exhaust flow path, has a high degree of freedom in shape, and provides a good yield rate in manufacturing.

In the exhaust gas stirring device, the shielding part is disposed so as to shield the central axis of the frame and its circumference in the axis direction of the frame. The shielding part may be disposed, for example, on a supporting part (first skeleton). Alternatively, shielding pieces, each of which configures a part of the shielding part, may be disposed on the plurality of supporting parts (first skeletons), and the shielding part may be configured by assembling these shielding pieces.

The first one of the plurality of assembling members may comprise the first one of the plurality of supporting parts having the pair of first skeletons, and a pair of the second skeletons respectively extended in an arc shape from both ends of the first one of the plurality of supporting parts. In this case, the frame and the plurality of supporting parts may be easily configured by assembling the plurality of assembling members.

In the first one of the plurality of assembling members, the vane parts disposed respectively on the pair of first skeletons may be formed in an identical shape, and the vane parts disposed respectively on the pair of the second skeletons may be formed in an identical shape. This facilitates the manufacturing of the assembling members.

In the plurality of assembling members, all of the vane parts disposed on the pair of first skeletons may be formed in an identical shape, and all of the vane parts disposed on the pair of the second skeletons may be formed in an identical shape. In this case, the plurality of assembling members can be formed into an identical or similar shape, and thus the yield rate can be improved.

The first one of the plurality of assembling members may be configured with one metal plate member. In this case, by bending the one metal plate member at a specified point, it is possible to easily manufacture an assembling member comprising the pair of first skeletons and the second skeletons that have vane parts formed thereon.

The one metal plate member may be formed of a single metal plate, or may be formed by combining a plurality of metal plates (for example, a tailored material and other materials). For example, a metal plate member that is made of two types of metal plates having different plate thicknesses may be used; the thicker one of the metal plates may be used to form the vane parts of the assembling members, and the thinner one of the metal plates may be used to form the parts other than the vane parts of the assembling members. In this case, the vane parts will have a greater rigidity, and therefore will be less deformable and will have an improved durability.

The plurality of supporting parts may be spaced at equal intervals so that the distances between each supporting part in the circumferential direction of the frame are equal. This can reduce bias in the flow of the exhaust gas and further improve the diffusibility of the exhaust gas. And, the diffusibility and the exhaust gas purifying performance of the reducing agent jetted into the exhaust gas can be further improved in the aforementioned exhaust gas purifying system.

EXPLANATION OF REFERENCE NUMERALS

Figures 1A, 1B, 1C:
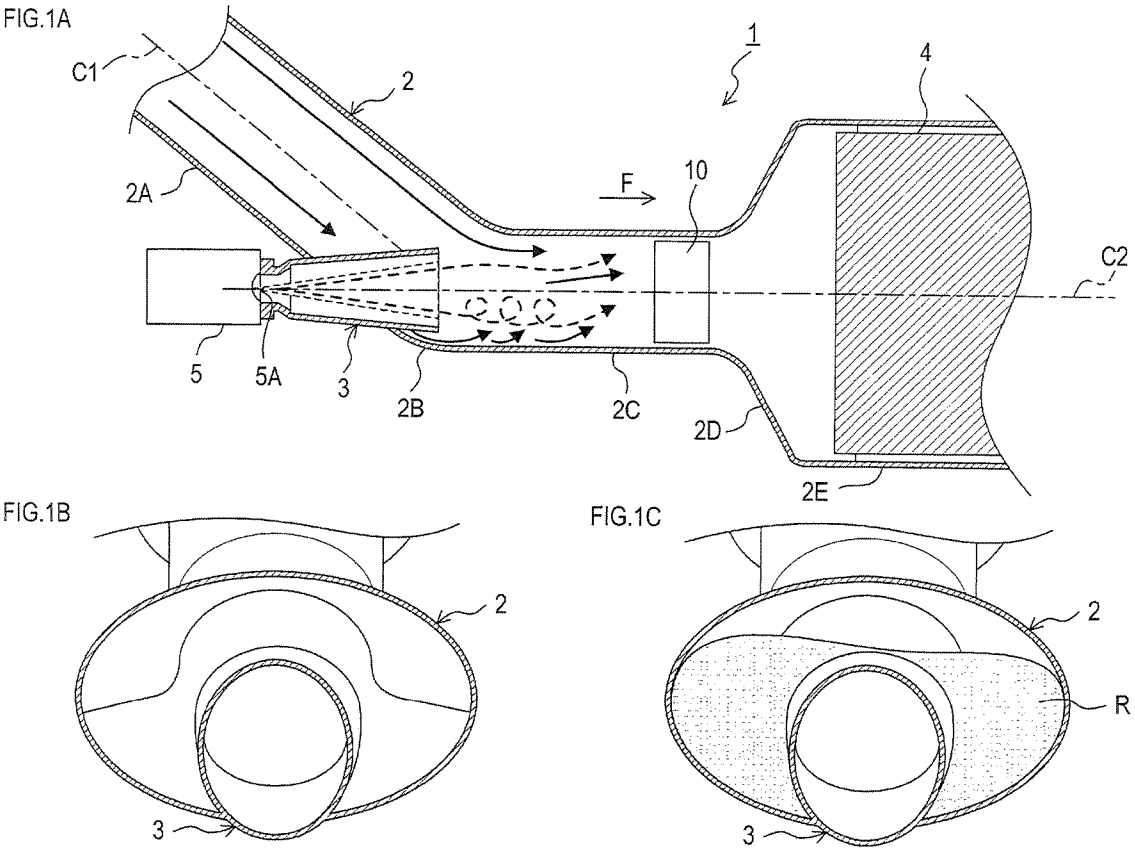
FIG. 1A is a sectional view of an exhaust gas purifying system according to a first embodiment.
FIG. 1B is a sectional view of a first flow path member and a second flow path member.
FIG. 1C is a drawing of FIG. 1B with its partial area emphasized.

10 . . . exhaust gas stirring device, 10A and 10B . . . assembling member, 11 . . . frame, 111 . . . second skeleton, 12 . . . supporting part, 121 . . . first skeleton, 13 . . . shielding part, 14 . . . vane part.

MODE FOR CARRYING OUT THE INVENTION

Embodiments of the present invention will be explained hereinafter with reference to the drawings.

First Embodiment

As illustrated in FIG. 1A, 1B to FIG. 4A, 4B, an exhaust gas stirring device 10 according to the present embodiment is an exhaust gas stirring device that stirs an exhaust gas flowing through an exhaust flow path. The exhaust gas stirring device 10 comprises a cylindrical frame 11 arranged on an inner surface of a flow path member (a first flow path member 2) to form the exhaust flow path, supporting parts 12 arranged to reach across the frame 11 in a radial direction, and a shielding part 13 shielding a central axis X of the frame 11 and its circumference in an axis direction of the frame 11.

As illustrated in the figures, a supporting part 12 comprises a pair of first skeletons 121 that extends outwardly from the central axis X of the frame 11 in the radial direction. The frame 11 and the supporting parts 12 are configured by assembling an assembling member 10A and an assembling member 10B. The assembling members 10A and 10B each comprise one pair of first skeletons 121; from one end of each first skeleton 121, a second skeleton 111 is extended in an arc shape and constitutes a part of the frame 11. Each first skeleton 121 and second skeleton 111 in the assembling members 10A and 10B comprises a vane part 14 that is formed to protrude from each first skeleton 121 and second skeleton 111. Details of this exhaust gas stirring device 10 will be explained hereinafter.

An exhaust gas purifying system 1 illustrated in FIG. 1A is for purifying the exhaust gas discharged from an internal combustion engine (for example, a diesel engine) of an automobile. The exhaust gas purifying system 1 comprises a first flow path member 2, a second flow path member 3, a catalyst 4, a jetting device 5, the exhaust gas stirring device 10, and other components. Although right-left and up-down directions (vertical direction and horizontal direction) will be described with reference to FIG. 1A in the explanations hereinafter, it is solely for convenience in the explanations and will not particularly limit the orientation of the exhaust gas purifying system 1.

The first flow path member 2 forms a part of the exhaust flow path to guide the exhaust gas discharged from the internal combustion engine to the outside of the automobile. Specifically, the first flow path member 2 forms the exhaust flow path that leads to the catalyst 4. The first flow path member 2 comprises a first tube part 2A, a second tube part 2B, a third tube part 2C, a fourth tube part 2D, and a fifth tube part 2E in this order from the upstream of the exhaust flow path (from the left side in FIG. 1A). The first tube part 2A to the fifth tube part 2E are sectioned for the convenience in the explanations; sectioning of the components of the first flow path member 2 will not be particularly limited.

The first tube part 2A is a circular tube part in a shape of a straight line. The third tube part 2C is a circular tube part in a shape of a straight line having the same inner diameter as the first tube part 2A. The third tube part 2C is different from the first tube part 2A in the direction of the flow of the exhaust gas. Specifically, the first tube part 2A forms a flow path that leads the exhaust gas to flow obliquely downward. The third tube part 2C forms a flow path that leads the exhaust gas to flow in the horizontal direction. Thereby, the first tube part 2A and the third tube part 2C are gently coupled together via the second tube part 2B that is curved into an ark-like shape in its side view.

The second tube part 2B is formed, for example, by joining two pieces of exterior members together for its upper part and lower part. An exhaust flow path formed by the second tube part 2B (where the second flow path member 3 is inserted) is enlarged (expanded) to both sides in width direction (in right-left direction in FIGS. 1B and 1C) compared to the first tube part 2A and the third tube part 2C. The width direction referred to herein means a direction that is perpendicular to both the first direction (obliquely downward direction), which is a direction of the flow of the exhaust gas that hits an exterior surface (specifically, an upper face) of the second flow path member 3, and the second direction (horizontal direction), which is an axis direction of the second flow path member 3. The first direction is a direction along a first axis C1, which is the central axis of the first tube part 2A. The second direction is a direction along a second axis C2, which is the central axis of the third tube part 2C. In the present embodiment, the first axis C1 and the second axis C2 are in a positional relation where they cross each other.

The fifth tube part 2E is a circular tube part in a shape of a straight line having a common axis with the third tube part 2C (having the second axis C2 as the central axis). The fifth tube part 2E is formed to have an inner diameter larger than that of the third tube part 2C, so as to house the catalyst 4 having a column shape with an outer diameter larger than the inner diameter of the third tube part 2C. Thereby, the third tube part 2C and the fifth tube part 2E are gently coupled together via the fourth tube part 2D, which is a circular tube part having a shape (a truncated conical shape in the present embodiment) to form the enlarged-diameter flow path to gradually enlarge the inner diameter of the exhaust flow path. In other words, the first flow path member 2 forms an exhaust flow path that comprises an enlarged-diameter flow path upstream of the catalyst 4 as the exhaust flow path leading to the catalyst 4.

The second flow path member 3 is so-called a dosing pipe that forms a flow path for the reducing agent to lead the reducing agent jetted from the jetting device 5 (dispersed in from a small-hole 5A located outside the exhaust flow path) to the upstream of the catalyst 4 in the exhaust flow path. The second flow path member 3 is a circular tube part having a common axis with the third tube part 2C (having the second axis C2 as the central axis). In the present embodiment, the second flow path member 3 is formed into a shape (a truncated conical shape in the present embodiment) having an inner diameter of the flow path for the reducing agent gradually enlarged towards the exhaust flow path so as not to let the jetted reducing agent easily in contact with the inner surface of the second flow path member 3 (so as not to let the inner surface of the second flow path member 3 easily eroded). The second flow path member 3 is coupled to the second tube part 2B of the first flow path member 2. The reducing agent jetted by the jetting device 5 is merged with the exhaust gas that flows inside the second tube part 2B. Specifically, the second flow path member 3 is inserted through a side wall of the second tube part 2B so as to protrude into the exhaust flow path (so as to locate a tip of the second flow path member 3 at the central part of the exhaust flow path).

As mentioned above, the point of insertion of the second flow path member 3 on the exhaust flow path is enlarged so as to widen to both sides in the width direction. Thereby, as illustrated in FIG. 1B, the exhaust flow path between the first flow path member 2 and the second flow path member 3 is formed to have side parts on both sides in the width direction wider than the upper part. Accordingly, the exhaust gas from the first tube part 2A can easily flow around an area R illustrated in FIG. 1C (an area provided around both sides in the width direction of the second flow path member 3). This generates the flow of the exhaust gas to scoop up the reducing agent from the second flow path member 3.

The catalyst 4 is an SCR (Selective Catalytic Reduction) type catalyst having a function to reduce nitrogen oxide (NOx). The catalyst 4 is disposed downstream of the enlarged-diameter flow path in the exhaust flow path (specifically, in the fifth tube part 2E).

The jetting device 5 jets the reducing agent in the form of a liquid, and functions as a supplying device to supply the reducing agent into upstream of the exhaust gas stirring device 10 in the exhaust flow path (specifically, into the second tube part 2B) via the second flow path member 3. In the present embodiment, the jetting device 5 jets a urea water as the reducing agent. To be exact, the urea water jetted into the exhaust gas is hydrolyzed by the heat of the exhaust gas and produces ammonia (NH3). And, thus produced ammonia functions as the reducing agent. A substance before undergoing hydrolysis (the urea water) is also referred to as the reducing agent herein.

The exhaust gas stirring device 10 is disposed upstream of the enlarged-diameter flow path in the exhaust flow path (within the third tube part 2C). The exhaust gas stirring device 10 guides the exhaust gas that flows into the exhaust gas stirring device 10 to circle around (so as to be stirred) and out to disperse into the enlarged-diameter flow path, and reduces the bias (close to uniformity) of the exhaust gas that flows into the catalyst 4.

Figure 2A:
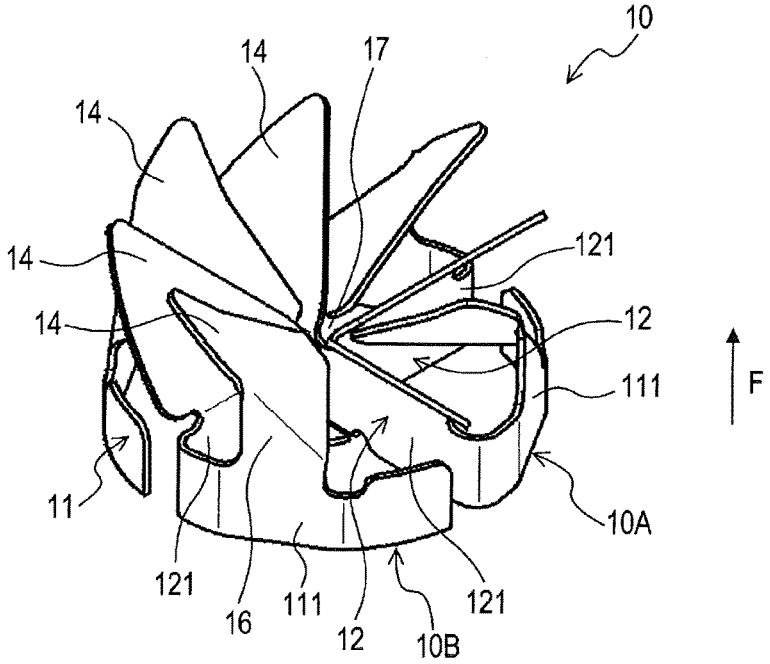
FIG. 2A is a perspective view of an exhaust gas stirring device according to the first embodiment as viewed from downstream of an exhaust flow path.
Figure 2B:
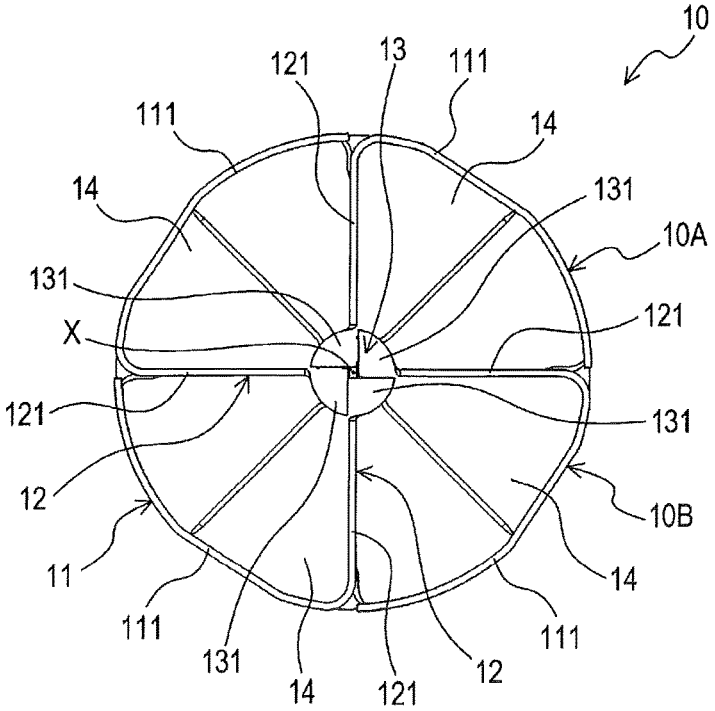
FIG. 2B is a front view of the exhaust gas stirring device according to the first embodiment as viewed along a central axis of the device from a direction that is upstream of the exhaust flow path.

As illustrated in FIGS. 2A and 2B, the exhaust gas stirring device 10 comprises the frame 11 and two supporting parts 12. An arrow F in FIG. 2A indicates a direction of the exhaust gas flow (a direction along the second axis C2) at an entering point into the exhaust gas stirring device 10.

The frame 11 is a part to be joined and fixed to an inner circumferential surface of the first flow path member 2 (specifically, of the third tube part 2C) by welding or other manners. The frame 11 is formed into a cylindrical shape so that an outer diameter of the frame 11 is sized to correspond to an inner diameter of the third tube part 2C (for example, equal to or slightly smaller than the inner diameter of the third tube part 2C). The frame 11 is arranged to have a common axis with the third tube part 2C (so as to have the second axis C2 as the central axis). The frame 11 is formed of second skeletons 111, which will be mentioned later.

The supporting part 12 is arranged to reach across inside the frame 11 in the radial direction so as to pass through the central axis X of the frame 11. The supporting part 12 comprises a pair of the first skeletons 121 that extends outwardly from the central axis X of the frame 11 in the radial direction. Two supporting parts 12 are spaced at equal intervals so that the distances between each supporting part 12 in the circumferential direction of the frame 11 are equal. In the present embodiment, the angle between each first skeleton 121 is 90° in the circumferential direction of the frame 11.

The exhaust gas stirring device 10 is configured by assembling two assembling members 10A and 10B. The assembling members 10A and 10B comprise the first skeletons 121, and the second skeletons 111 respectively extended in an arc shape from one end (outer end) of the first skeletons 121. The arc shape referred to herein includes, for example, not only mild curves as in an arc but also shapes with a plurality of line segments connected in a polygonal line. In the present embodiment, the assembling members 10A and 10B each comprise one supporting part 12 having a pair of the first skeletons 121, and a pair of the second skeletons 111 extended in an arc shape from both ends of the supporting part 12. The second skeletons 111 form a part of the frame 11. The frame 11 is configured to include four second skeletons 111 provided on two assembling members 10A and 10B.

The supporting part 12 of one assembling member 10A comprises a slit 15 formed thereon by cutting from the upstream direction towards the downstream direction of the exhaust flow path. The supporting part 12 of the other assembling member 10B comprises a slit 15 formed thereon by cutting from the downstream direction towards the upstream direction of the exhaust flow path. Two assembling members 10A and 10B are assembled together by engaging their slits 15 to each other.

Each of the pair of the first skeletons 121 and the pair of the second skeletons 111 in the assembling members 10A and 10B comprises one vane part 14. More specifically, four vane parts 14 are disposed on each of the assembling members 10A and 10B. The vane parts 14 are bent from the first skeletons 121, or, bent from the second skeletons 111 via erecting portions 16, and are formed to protrude towards the downstream of the exhaust flow path. Surfaces of the vane parts 14 are formed flat. The vane parts 14 formed on the first skeletons 121 and the vane parts 14 formed on the second skeletons 111 of the supporting part 12 are each arranged at equal intervals alternately one by one along the circumferential direction of the frame 11.

In each of the assembling members 10A and 10B, two vane parts 14 disposed on the pair of the first skeletons 121 share the same shape; and two vane parts 14 disposed on the pair of the second skeletons 111 share the same shape. In two assembling members 10A and 10B, the total of four vane parts 14 respectively disposed on the first skeletons 121 shares the same shape; and the total of four vane parts 14 respectively disposed on the second skeletons 111 share the same shape.

The vane parts 14 are designed to overlap with one another in the circumferential direction so as not to form an area where no vane parts 14 exist when viewed from the direction along a second axis C2 as much as possible. An area where no vane parts 14 exist (a vaneless part 17) is formed on the central axis X of the frame 11 and its circumference (central part) inside the frame 11 when viewed from the direction along the second axis C2. On the vaneless part 17, a plate-like shielding part 13 is disposed so as to shield the vaneless part 17. The shielding part 13 is configured to include a plurality (four, in the present embodiment) of shielding pieces 131. Each of the shielding pieces 131 is disposed on an edge, which faces the upstream side of the exhaust flow path, of each first skeleton 121 of the assembling members 10A and 10B.

As mentioned above, the vane parts 14 and the shielding part 13 are designed so that the proportion of the aperture (opening area), where none of the vane parts 14 and the shielding part 13 exist, inside the frame 11 is close to 0% when viewed from the direction along the second axis C2.

A method of manufacturing the exhaust gas stirring device 10 is explained next. As illustrated in FIG. 3A, 3B and FIG. 4A, 4B, two assembling members 10A and 10B of the exhaust gas stirring device 10 are each formed of one metal plate member, respectively, 10*a* and 10*b*. The metal plate members 10*a* and 10*b* are formed of a single metal plate (for example, a stainless-steel plate).

Figure 3A:
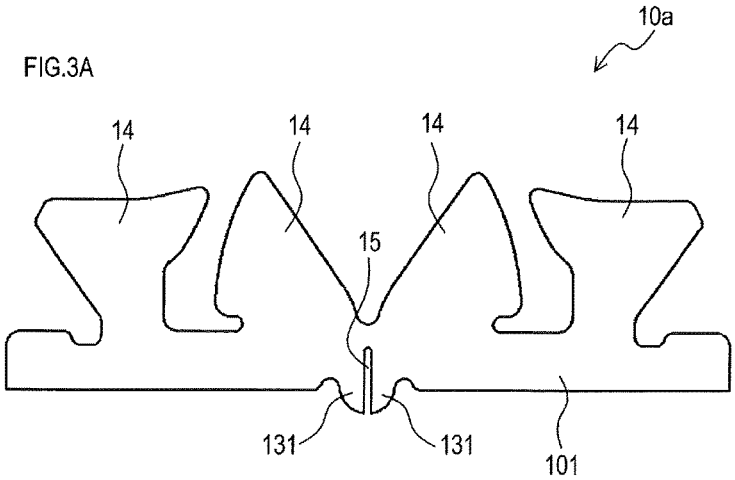
FIG. 3A is a drawing representing a planar metal plate that is a material for one assembling member.

The metal plate member 10*a* is formed for manufacturing one assembling member 10A; the metal plate member 10*a* comprises a belt part 101 for forming the pair of the first skeletons 121 and the pair of the second skeletons 111, the vane parts 14, and the shielding pieces 131 integrated together as illustrated in FIG. 3A. This step is achieved by processings such as pressing out a shape illustrated in FIG. 3A and cutting out the shape on a laser from, for example, a rectangular metal plate member.

The belt part 101 is a part that forms the pair of the first skeletons 121 and the pair of the second skeletons 111; in other words, the belt part 101 is a part that forms a portion of the supporting part 12 and the frame 11 which are in one piece. The belt part 101 is in a shape of a straight line and also of a belt. The vane parts 14 are formed to protrude from one end-side of the belt part 101 in the width direction (upper side in FIG. 3A). The shielding pieces 131 are formed to protrude from other end-side of the belt part 101 in the width direction (bottom side in FIG. 3A) at the middle part of the belt part 101. The slit 15, which is cut from the other end-side towards the one end-side in the width direction, is formed at the middle part of the belt part 101.

Next, a processing to partially bend the vane parts 14 to a desired angle is applied to the metal plate member 10*a*. In this processing, one of two vane parts 14, which are formed on the portions that form the second skeletons 111, is bent to a near side of the belt part 101, and the other vane part 14 is bent to a far side of the belt part 101. Likewise, one of two vane parts 14, which are formed on portions that form the first skeletons 121, is bent to the near side of the belt part 101, and the other vane part 14 is bent to the far side of the belt part 101.

Figure 3B:
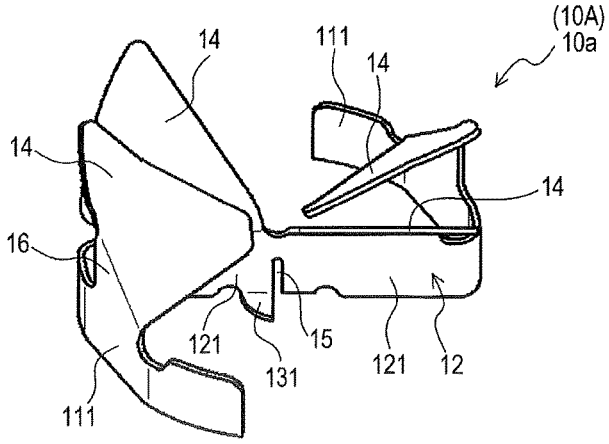
FIG. 3B is a perspective view representing the metal plate (the one assembling member) after a step for bending a second skeleton and a shielding piece.

Next, as illustrated in FIG. 3B, a processing to bend both end parts of the belt part 101 to form the ark-like second skeletons 111 is applied to the metal plate member 10*a*. In this processing, the circumferential direction to bend both end parts of the belt part 101 is the same as each other. In addition, a processing to alternately bend two shielding pieces 131 to the near side and the far side of the supporting part 12 (the first skeletons 121) is applied to the metal plate member 10*a*. As a result of these processings, the one assembling member 10A can be obtained.

Figure 4A:
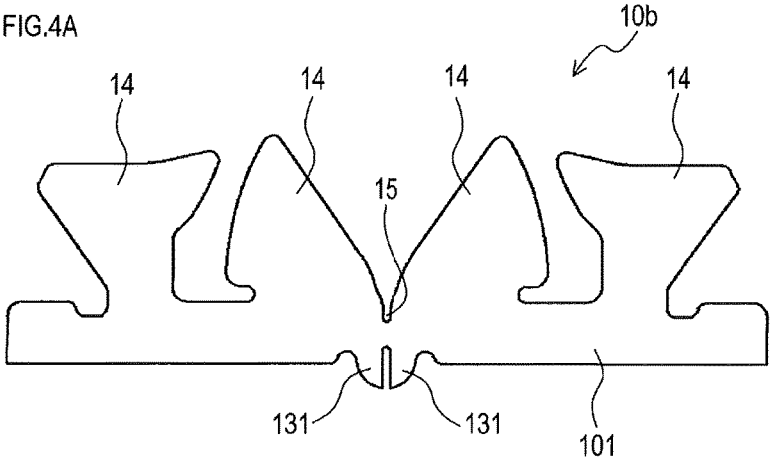
FIG. 4A is a drawing representing a planar metal plate that is a material for an other assembling member.

The metal plate member 10*b* is formed for manufacturing the other assembling member 10B in a like manner as described for the one assembling member 10A; the metal plate member 10*b* comprises the belt part 101 for forming the pair of the first skeletons 121 and the pair of the second skeletons 111, the vane parts 14, and the shielding pieces 131 integrated together as illustrated in FIG. 4A. The slit 15, which is cut from the one end-side (upper side in FIG. 4A) towards the other end-side (bottom side in FIG. 4A) in the width direction, is formed at the middle part of the belt part 101.

Figure 4B:
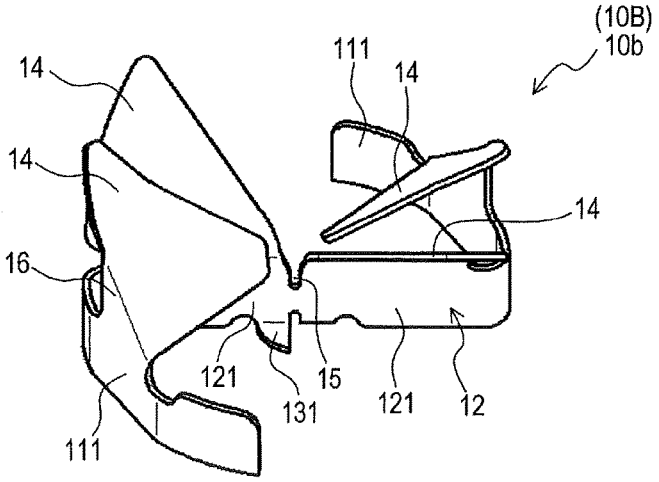
FIG. 4B is a perspective view representing the metal plate (the other assembling member) after a step for bending the second skeleton and the shielding piece.

Next, a processing to partially bend the vane parts 14 to a desired angle is applied to the metal plate member 10*b* in a like manner as described for the one assembling member 10A. And then, as illustrated in FIG. 4B, a processing to bend both end parts of the belt part 101 to form the ark-like second skeletons 111 is applied to the metal plate member 10*b*. In addition, a processing to alternately bend two shielding pieces 131 to the near side and the far side of the supporting part 12 (the first skeletons 121) is applied to the metal plate member 10*b*. As a result of these processings, the other assembling member 10B can be obtained.

Next, the slit 15 of the one assembling member 10A is inserted to the slit 15 of the other assembling member 10B and the slits 15 of both members are engaged each other. Thereby, the exhaust gas stirring device 10 that is configured by assembling two assembling members 10A and 10B is manufactured.

Function of the exhaust gas purifying system 1 is explained next.

As illustrated in FIG. 1A, the exhaust gas discharged from the internal combustion engine is guided to the exhaust gas stirring device 10 via the exhaust flow path, and then guided to the catalyst 4 after passing through the exhaust gas stirring device 10. Meanwhile, the reducing agent jetted from the jetting device 5 is guided to the central part of the exhaust flow path via the flow path for the reducing agent, and then joins with the exhaust gas.

A part of the second flow path member 3 inserted into the exhaust flow path has a function of guiding an exhaust gas that hits the upper face on the exterior surface of the second flow path member 3, among the exhaust gas that flows from the first tube part 2A to the second tube part 2B, to go around along the exterior surface of the second flow path member 3. Thereby, the reducing agent that flowed out of the second flow path member 3 is scooped up and dispersed in the exhaust flow path.

The exhaust gas that flowed into the exhaust gas stirring device 10 is then guided by the vane parts 14 to circle around (so as to be stirred), flows out to disperse into the enlarged-diameter flow path, and flows into the catalyst 4 with a reduced bias. In addition, the reducing agent jetted into the exhaust gas hits the shielding part 13 of the exhaust gas stirring device 10 and disperses. The dispersed reducing agent is further guided by the vane parts 14 to circle around, flows out to disperse into the enlarged-diameter flow path, and flows into the catalyst 4 with a reduced bias. Thereby, the reducing agent is efficiently dispersed.

A function effect of the exhaust gas stirring device 10 according to the present embodiment is explained next.

In the exhaust gas stirring device 10 according to the present embodiment, the frame 11 and the supporting parts 12 are configured by assembling the assembling members 10A and 10B. The assembling members 10A and 10B each comprise the first skeletons 121, and the second skeletons 111 that are respectively extended in an arc shape from one end of each of the first skeletons 121; and each of the first skeletons 121 and the second skeletons 111 comprises the vane part 14. Thus, a large number of the vane parts 14 can be arranged efficiently on the frame 11 and on the supporting parts 12, and the diffusibility of the exhaust gas can be improved. In the exhaust gas purifying system 1 in the present embodiment, the diffusibility and the exhaust gas purifying performance of the reducing agent jetted into the exhaust gas can be particularly improved.

The exhaust gas stirring device 10 also comprises the shielding part 13 that shields the central axis X of the frame 11 and its circumference in the axis direction of the frame 11. More specifically, the shielding part 13 is disposed on an area inside the frame 11 where the aperture, which has no vane parts 14 when viewed from the direction along the central axis X of the frame 11, may be easily formed. Thus, the occurrence of bias in the flow of the exhaust gas and weakening of the diffusibility of the exhaust gas can be reduced. In the aforementioned exhaust gas purifying system 1, the shielding part 13 can particularly reduce a slipping-through of the reducing agent jetted into the exhaust gas. The reducing agent jetted into the exhaust gas is diffused by hitting the shielding part 13 and is further diffused at the vane part 14, thus providing additional effect of improving the diffusibility of the reducing agent.

As mentioned above, the frame 11 and the supporting parts 12 are configured by assembling the assembling members 10A and 10B in the exhaust gas stirring device 10. Thereby, the whole shape of the frame 11 and the supporting parts 12 can be easily altered to meet a required performance or other requirements, and the degree of freedom in shape thereof can be improved. And, a yield rate in manufacturing can also be improved by shaping the parts that configure the assembling members 10A and 10B (for example, the first skeletons 121, the second skeletons 111, the vane parts 14, and other parts) into an identical or similar shape.

In the exhaust gas stirring device 10 according to the present embodiment, the assembling members 10A and 10B each comprise the supporting part 12 having a pair of the first skeletons 121, and a pair of the second skeletons 111 respectively extended in an arc shape from both ends of the supporting part 12. Thus, the frame 11 and the supporting parts 12 can be easily configured by assembling the assembling members 10A and 10B.

In the assembling members 10A and 10B, the vane parts 14 disposed respectively on the pair of the first skeletons 121 are formed in an identical shape, and the vane parts 14 disposed respectively on the pair of the second skeletons 111 are formed in an identical shape. This facilitates the manufacturing of the assembling members 10A and 10B.

In the assembling members 10A and 10B, the vane parts 14 disposed on the first skeletons 121 are formed in an identical shape, and the vane parts 14 disposed on the second skeletons 111 are formed in an identical shape. Thereby, the assembling members 10A and 10B can be formed into a similar shape, and the yield rate can thus be improved.

The assembling members 10A and 10B are each configured with one metal plate member, respectively, 10A and 10B. Thereby, by bending the metal plate members 10A and 10B at a specified point, it is possible to easily manufacture the assembling members 10A and 10B each comprising the first skeletons 121 and the second skeletons 111 that have the vane parts 14 formed thereon.

The supporting parts 12 are spaced at equal intervals so that the distances between each supporting part 12 in the circumferential direction of the frame 11 are equal. This can reduce the bias in the flow of the exhaust gas and further improve the diffusibility of the exhaust gas. And, in the aforementioned exhaust gas purifying system 1, the diffusibility of and the exhaust gas purifying performance the reducing agent jetted into the exhaust gas can be further improved.

As mentioned above, it is possible to provide the exhaust gas stirring device 10 that is capable of improving the diffusibility of the exhaust gas in the exhaust flow path, has a high degree of freedom in shape, and provides a high yield rate in manufacturing.

Second Embodiment

Figure 5A:
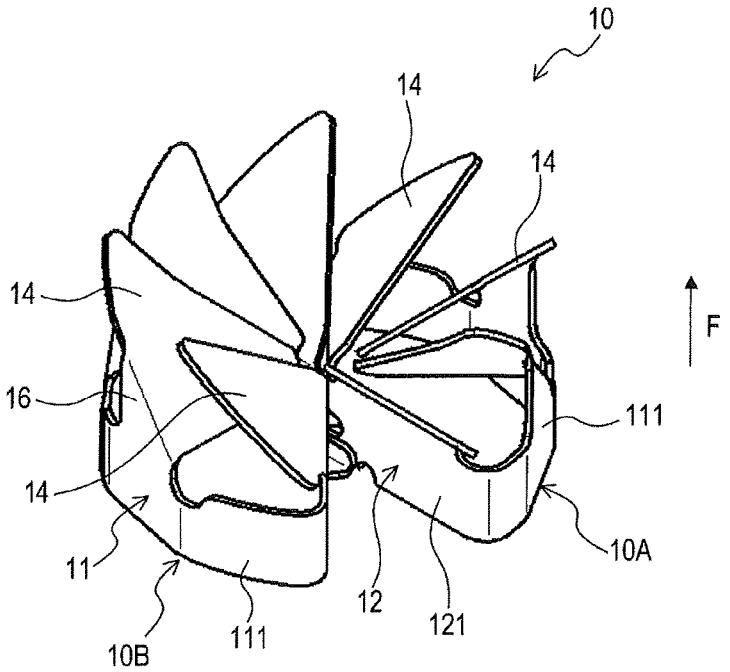
FIG. 5A is a perspective view of an exhaust gas stirring device according to a second embodiment as viewed from downstream of an exhaust flow path.
Figure 5B:
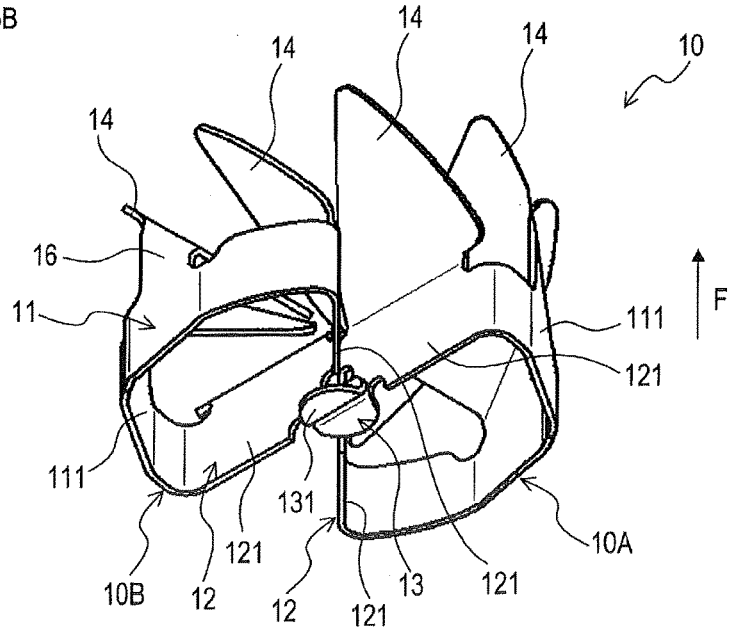
FIG. 5B is a perspective view of the exhaust gas stirring device according to the second embodiment as viewed from upstream of the exhaust flow path.

As illustrated in FIGS. 5A and 5B, the present embodiment provides a modified example of the configuration of the assembling members 10A and 10B in the exhaust gas stirring device 10.

As illustrated in FIGS. 5A and 5B, assembling members 10A and 10B each comprise two first skeletons 121 and one second skeleton 111. One of the two first skeletons 121 belongs to one of two supporting parts 12, and the other one of the two first skeletons 121 belongs to the other one of two supporting part 12. The second skeleton 111 is formed so as to couple the outer ends of the two first skeletons 121.

The frame 11 is configured with two second skeletons 111 provided on the two assembling members 10A and 10B; the shape of the frame 11 in the circumferential direction is partially incomplete. Unlike the first embodiment, the two supporting parts 12 are not spaced at equal intervals in the circumferential direction of the frame 11. In the present embodiment, the angle between each first skeleton 121 is 60° or 120° in the circumferential direction of the frame 11. The shielding part 13 is configured with two shielding pieces 131. Each of the shielding pieces 131 are respectively disposed on the assembling members 10A and 10B.

The assembling members 10A and 10B do not comprise a slit 15 as in the first embodiment (see, FIGS. 3A, 3B, 4A, and 4B); the first skeletons 121 are assembled each other by joining such as welding near the central axis X of the frame 11. Other basic configurations and function effects are the same as those in the first embodiment.

Third Embodiment

Figure 6:
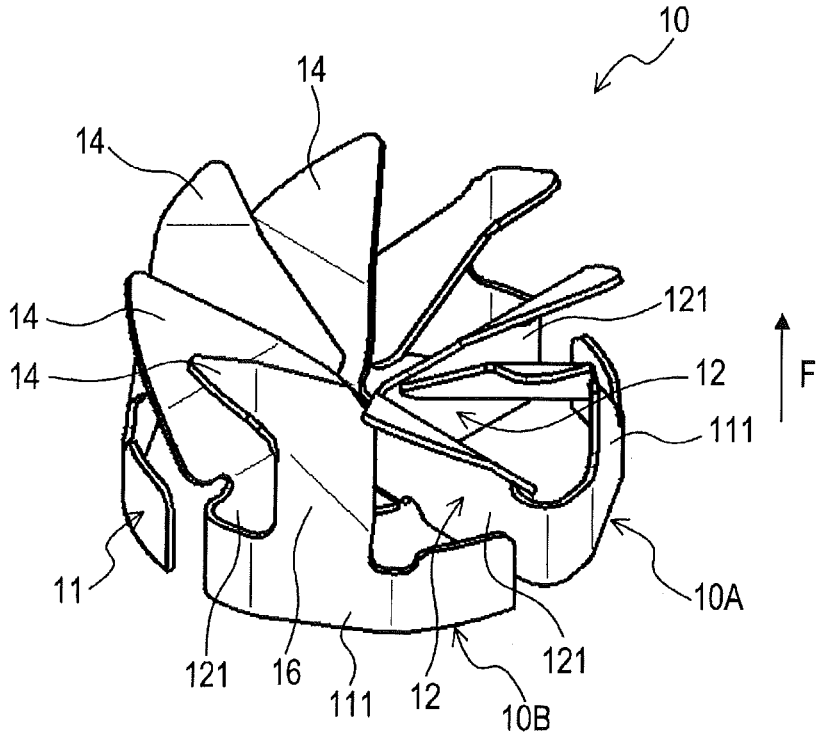
FIG. 6 is a perspective view of an exhaust gas stirring device according to a third embodiment as viewed from downstream of an exhaust flow path.

As illustrated in FIG. 6, the present embodiment provides a modified example of the configuration of the vane part 14 in the exhaust gas stirring device 10.

As illustrated in FIG. 6, tip portions of vane parts 14 provided on first skeletons 121 and second skeletons 111 in assembling members 10A and 10B are bent. The bent portions of the vane parts 14 on the first skeletons 121 are larger than the bent portions of the vane parts 14 on the second skeletons 111. Other basic configurations and function effects are the same as those in the first embodiment.

Fourth Embodiment

Figure 7A:
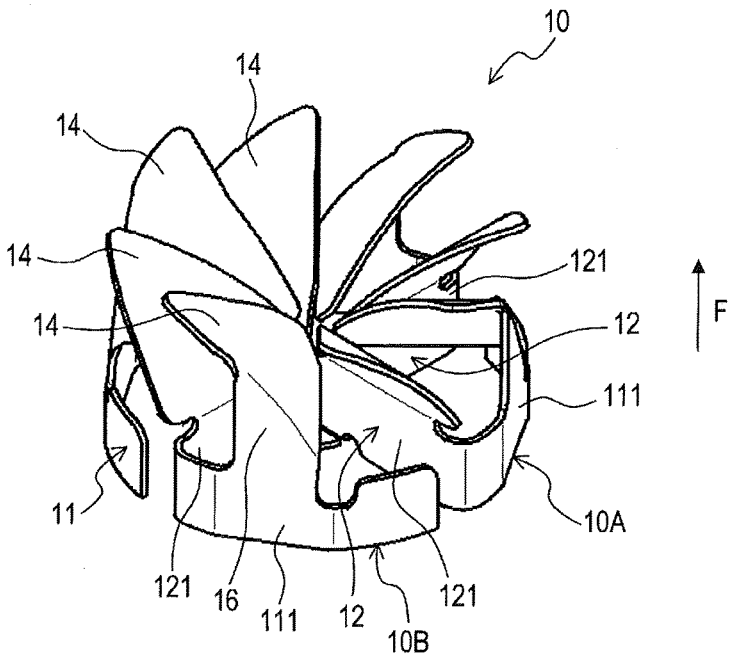
FIG. 7A is a perspective view of an exhaust gas stirring device according to a fourth embodiment as viewed from downstream of an exhaust flow path.
Figure 7B:
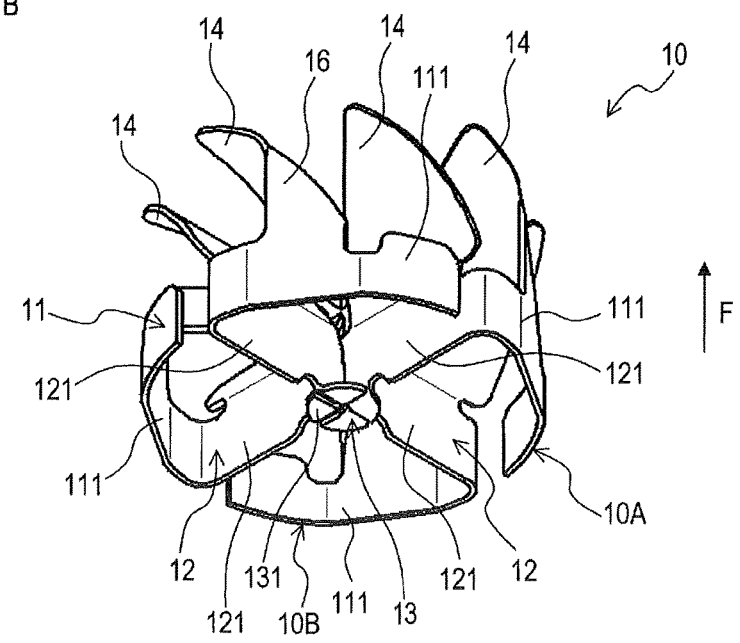
FIG. 7B is a perspective view of the exhaust gas stirring device according to the fourth embodiment as viewed from upstream of the exhaust flow path.

As illustrated in FIGS. 7A and 7B, the present embodiment provides a modified example of the configuration of the vane part 14 in the exhaust gas stirring device 10.

As illustrated in FIGS. 7A and 7B, surfaces of the vane parts 14 provided on first skeletons 121 and second skeletons 111 in assembling members 10A and 10B are not flat surfaces unlike the first embodiment (see, FIG. 2A) but are gently curved surfaces. Other basic configurations and function effects are the same as those in the first embodiment.

Fifth Embodiment

Figure 8A:
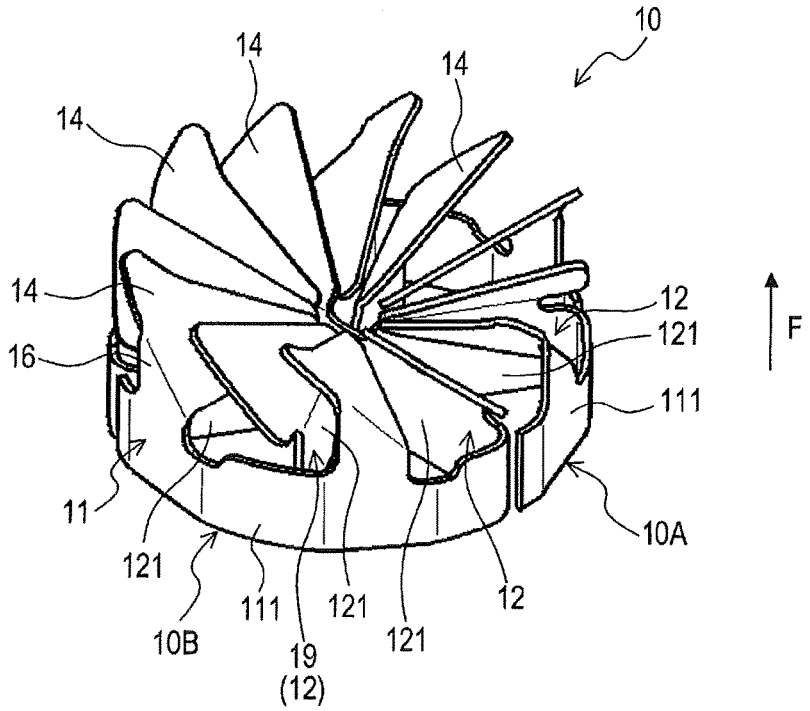
FIG. 8A is a perspective view of an exhaust gas stirring device according to a fifth embodiment as viewed from downstream of an exhaust flow path; and, FIG. 8B is a perspective view of the exhaust gas stirring device according to the fifth embodiment as viewed from upstream of the exhaust flow path.
Figure 8B:
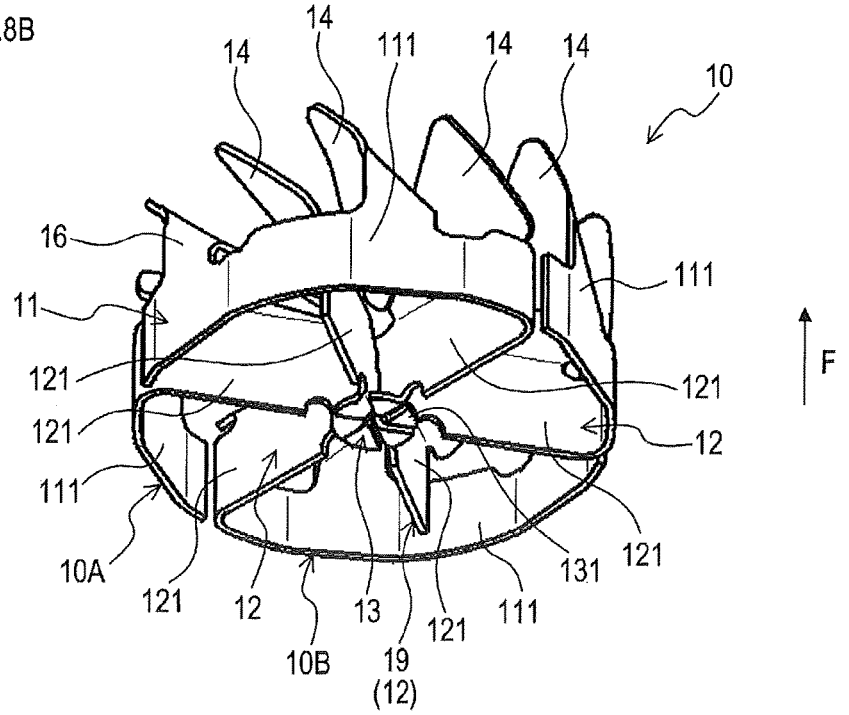

As illustrated in FIGS. 8A and 8B, the present embodiment provides a modified example of the configuration of the exhaust gas stirring device 10.

As illustrated in FIGS. 8A and 8B, an exhaust gas stirring device 10 comprises two assembling members 10A and 10B, and one auxiliary member 19, and is configured by assembling these members. The auxiliary member 19 comprises one supporting part 12 having a pair of first skeletons 121. Each one of the pair of first skeletons 121 on the auxiliary member 19 comprises one vane part 14. Each one of a pair of first skeletons 121 and a pair of second skeletons 111 on the assembling member 10A comprises one vane part 14. Each one of a pair of first skeletons 121 on the assembling member 10B comprises one vane part 14. Each one of a pair of second skeletons 111 on the assembling member 10B comprises two vane parts 14. Thereby, the exhaust gas stirring device 10 comprises 12 vane parts 14 in total.

Three supporting parts 12 are spaced at equal intervals so that the distances between each supporting part 12 in the circumferential direction of frame 11 are equal. In the present embodiment, the angle between each first skeleton 121 is 60° in the circumferential direction of the frame 11.

A shielding part 13 is configured with six shielding pieces 131. The assembling members 10A and 10B and the auxiliary member 19 each comprise two shielding pieces 131. Other basic configurations and function effects are the same as those in the first embodiment.

Other Embodiments

It should be noted that the present invention is not limited at all to the aforementioned embodiments and may be practiced in various modes within the scope of the present invention.

(1) The shapes of the exhaust gas stirring device 10, such as the number and shapes of the vane part 14, are not limited to those illustrated as examples in the aforementioned embodiments. Although each first skeleton 121 comprises one vane part 14 in the aforementioned embodiments, two or more vane parts 14 may be provided; and likewise for the second skeleton 111.

Although the vane part 14 is provided in two shapes in the aforementioned embodiments, it may be provided in one shape, or in three or more shapes.

(2) The assembling members that configures the exhaust gas stirring device 10 may be two in number as in the aforementioned embodiments, or they may be three or more in number. The cross-sectional shape of the frame 11 is not limited to a circular shape; it may be, for example, an ellipsoidal shape or a multangular shape or other shapes. The number of the supporting part 12 may be changed to any number equal to or greater than two. The shape of the shielding part 13 is also not limited to those illustrated as examples in the aforementioned embodiments.

(3) Single metal plate members 10*a* and 10*b*, which respectively are materials of the assembling members 10A and 10B in the exhaust gas stirring device 10, may be formed by combining several types of metal plates such as to form a tailored material. For example, one metal plate member made by combining two types of metal plates having different plate thickness may be used as a material; the thinner part may be used to form the first skeleton 121 and the second skeleton 111, and the thicker part may be used to form the vane part 14. In this case, the vane part 14 will have a greater rigidity, and therefore, will be less deformable and will have an improved durability.

(4) The exhaust flow path and the flow path for the reducing agent in the aforementioned embodiments are only examples; thus, an exhaust flow path and a flow path for the reducing agent are not limited to those examples. For example, assuming the configuration that the second flow path member 3 protrudes into the exhaust flow path, the cross-sectional shape of a part of the first flow path member 2 is made longer in width in the aforementioned embodiment; however, the cross-sectional shape of at least a part of a second flow path member 3 may be made longer in height. Alternatively, for example, a configuration may comprise a second flow path member 3 that does not protrude into the exhaust flow path; and the cross-sectional shapes of a first flow path member 2 and a second flow path member 3 may each be circular shapes. Alternatively, for example, a first tube part 2A and a third tube part 2C may have different inner diameters, and it is not required that a third tube part 2C, a fifth tube part 2E, and a second flow path member 3 share a common axis. Alternatively, for example, the exhaust flow path is not limited to having an enlarged-diameter flow path; the exhaust flow path may not have an enlarged-diameter flow path (5) A reducing agent is not limited to urea water; it is only required that a reducing agent contributes to purification of an exhaust gas in a catalyst. In addition, the present invention may be applied to exhaust systems other than exhaust gas purifying systems that utilize a reducing agent.

(6) Functions of one component in the aforementioned embodiments may be distributed as two or more components; or, functions of two or more components may be combined into one component. At least a part of the configurations in the aforementioned embodiments may be replaced with known configurations having the same functions. At least a part of the configurations in the aforementioned embodiments may be omitted insofar as the problem can still be solved. At least a part of the configurations of the aforementioned embodiments may be added to or replaced with the configurations of other embodiments. Embodiments of the present invention include any modes that are encompassed in the technical ideas identified by the languages used in the claims.

(7) The present invention can be realized in variety of forms, besides the aforementioned exhaust gas stirring device, such as exhaust gas purifying systems comprising the exhaust gas stirring device as a component, and methods of reducing bias in the flow of the exhaust gas.

The invention claimed is:

1. An exhaust gas stirring device that stirs an exhaust gas flowing through an exhaust flow path, comprising:

a frame in a cylindrical shape arranged on an inner surface of a flow path member that forms the exhaust flow path;

supporting parts arranged to reach across the frame in a radial direction;

a shielding part intersecting and orthogonal to a central axis of the frame to block flow near the central axis, wherein a first one of the supporting parts comprises a pair of first skeletons that extends outwardly from the central axis of the frame in a radial direction, wherein the frame and the supporting parts are configured by combining assembling members, wherein a first one of the assembling members comprises the pair of first skeletons, and second skeletons that are respectively extended in an arc shape from one end of each one of the pair of first skeletons and constitute a part of the frame, wherein each skeleton comprises a respective vane part that is formed to protrude, and wherein each first skeleton includes a respective shielding piece that is bent orthogonal to the central axis, such that the shielding pieces combine to form the shielding part.

2. The exhaust gas stirring device according to claim 1, wherein the first one of the assembling members comprises the first one of the supporting parts having the pair of first skeletons, and a pair of the second skeletons respectively extended in an arc shape from both ends of the first one of the supporting parts.

3. The exhaust gas stirring device according to claim 2, wherein, in the first one of the assembling members, the vane parts disposed respectively on the pair of first skeletons are each formed in a first shape, and the vane parts disposed respectively on the pair of the second skeletons are each formed in a second shape.

4. The exhaust gas stirring device according to claim 1, wherein, in the plurality of assembling members, all of the vane parts disposed on the pair of first skeletons are each formed in the first shape, and all of the vane parts disposed on the second skeletons are each formed in the second shape.

5. The exhaust gas stirring device according to claim 1, wherein the first one of the assembling members is formed by bending a single plate member.

6. The exhaust gas stirring device according to claim 1, wherein the supporting parts are spaced at equal intervals so that distances between each of the supporting parts in the circumferential direction of the frame are equal.

7. An exhaust gas stirring device that stirs an exhaust gas flowing through an exhaust flow path, comprising:

assembling members combined to form:

a frame in a cylindrical shape arranged on an inner surface of a flow path member that forms the exhaust flow path;

supporting parts arranged to radially extend across the frame; and a shielding part intersecting and orthogonal to a central axis of the frame to block axial flow of exhaust gas near the central axis of the frame, wherein each of the assembling members comprises a pair of first skeletons, and second skeletons, each first skeleton extending radially outward from a central axis of the frame to collectively form at least a portion of the supporting parts, and each second skeleton extending from one end of one of the first skeletons in an arc shape to collectively form at least a portion of the frame, wherein each of the first skeletons and the second skeletons comprises a respective vane part protruding therefrom, and wherein each first skeleton includes a respective shielding piece orthogonal to the central axis to collectively form at least a portion of the shielding part.

* * * * *